US009527194B2

(12) United States Patent
Kerboul et al.

(10) Patent No.: US 9,527,194 B2
(45) Date of Patent: Dec. 27, 2016

(54) POLYAXIAL RATCHET TOOL

(75) Inventors: Guillaume Kerboul, Quimper (FR); James William Truscott, Swindon (GB); Jose Fernandez, Wrentham, MA (US)

(73) Assignee: Symmetry Medical, Inc., Warsaw, IN (US)

( * ) Notice: Subject to any disclaimer, the term of this patent is extended or adjusted under 35 U.S.C. 154(b) by 831 days.

(21) Appl. No.: 13/331,257

(22) Filed: Dec. 20, 2011

(65) Prior Publication Data

US 2013/0152747 A1 Jun. 20, 2013

(51) Int. Cl.

| | |
|---|---|
| ***B25B 23/142*** | (2006.01) |
| ***B25B 23/00*** | (2006.01) |
| *B25B 13/46* | (2006.01) |

(52) U.S. Cl.

CPC ..... *B25B 23/1427* (2013.01); *B25B 23/0028* (2013.01); *B25B 13/463* (2013.01); *B25B 13/465* (2013.01)

(58) Field of Classification Search

CPC ..... B25B 13/46; B25B 13/463; B25B 13/465; B25B 23/1427; B25B 23/0028

USPC ..... 81/61–63.2

See application file for complete search history.

(56) References Cited

U.S. PATENT DOCUMENTS

| | | | | | |
|---|---|---|---|---|---|
| 334,010 | A * | 1/1886 | Follett | 81/63 | |
| 2,179,855 | A * | 11/1939 | Latimer | B25B 13/463 81/482 | |
| 2,332,972 | A * | 10/1943 | Johnson | 81/480 | |
| 2,686,446 | A * | 8/1954 | Livermont | 81/482 | |
| 3,003,378 | A * | 10/1961 | Hotchner | 81/475 | |
| 3,635,654 | A * | 1/1972 | McFarland | 405/210 | |
| 3,754,486 | A * | 8/1973 | Mariner | 81/63 | |
| 4,019,412 | A * | 4/1977 | Kraus et al. | 81/482 | |
| 5,224,403 | A * | 7/1993 | Rueb | 81/477 | |
| 5,325,744 | A * | 7/1994 | Horikawa | 81/63.2 | |
| 5,946,987 | A * | 9/1999 | Wei | 81/63.2 | |
| 6,260,447 | B1 * | 7/2001 | Hutt | 81/63 | |
| 6,318,216 | B1 * | 11/2001 | Eggert et al. | 81/61 | |
| 6,990,877 | B1 * | 1/2006 | Wu | 81/467 | |
| 7,481,139 | B2 * | 1/2009 | Hsieh | 81/478 | |
| 8,671,808 | B2 * | 3/2014 | Huang | 81/177.75 | |

* cited by examiner

*Primary Examiner* — Hadi Shakeri
*Assistant Examiner* — Danny Hong
(74) *Attorney, Agent, or Firm* — Christopher & Weisberg, P.A.

(57) ABSTRACT

A polyaxial tool, including an elongate body defining a first end, a second and a longitudinal axis extending therebetween; the elongate body defining a cavity at the first end; a plurality of arcuate gear teeth circumferentially arranged in the cavity and movable with respect to the elongate body; a socket coupled to the housing and coaxial with the plurality of gear teeth; and a handle coupled to the second end, where an angular position of at least one of the elongate body and handle is adjustable with respect to the plurality of gear teeth.

9 Claims, 2 Drawing Sheets

POLYAXIAL RATCHET TOOL

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates to driving or rotary tools, and, more particularly, to tools and devices for driving fasteners or other hardware.

BACKGROUND OF THE INVENTION

Many hand tools (electric and manual) include a unitary body and handle having a longitudinal axis collinear with the axis of rotation of a drive member (e.g. screwdriver head), which presents an obstacle to use when attempting to secure or drive a fastener in a difficult or small working area—which is particularly prevalent in medical or surgical procedures. Attempts to address this problem have included providing a head of the hand tool that may pivot or rotate on the handle. However, such previous tools are typically limited to a small number of discrete angular positions along a single plane, e.g., adjustments are limited to perpendicular, straight or 45-degree angles. Such devices further typically include a pivoting joint that is offset or spaced away from a fastener to be driven, thus requiring some extended degree of clearance or space to be used, which can still pose difficulties to use in tortuous working spaces. In addition, tools having torque-limiting assemblies often compound the lack of maneuverability or usefulness in tight spaces because of their associated bulk and complexity.

Accordingly, in view of the above, it is desirable to provide a surgical or medical practitioner with an improved driving tool or wrench with a wide range of angular adjustability and compactness at a fastener or hardware engagement site that is readily usable in tortuous anatomical spaces and surgical sites.

SUMMARY OF THE INVENTION

The present invention advantageously provides tools and devices for a surgical or medical practitioner, the tools having a wide range of angular adjustability and compactness at a fastener or hardware engagement site that is readily usable in tortuous anatomical spaces and surgical sites. In particular, a polyaxial driver is provided, including a socket adapted to couple to a fastener; a plurality of arcuate gear teeth circumscribing the socket; and a driver body engageable with the gear teeth to rotate the socket, where the driver body forms a ball-and-socket joint with the gear teeth. The driver body may engage the gear teeth to rotate the socket until a maximum torque threshold is reached, causing the driver body to disengage the gear teeth. The driver may include a pin coupled to the driver body, where the pin engages the gear teeth to rotate the socket. The pin may disengage the gear teeth when the maximum torque threshold is exceeded. The maximum torque threshold may be adjustable. The socket may include a passage therethrough adapted to receive the fastener from either side of the passage. The driver may include an adapter coupled to the socket to couple to the fastener and/or a handle attached to the driver body.

A wrench is provided, including an elongate body defining a passage through a first end thereof; a plurality of gear teeth arranged in a substantially spherical configuration and movable with respect to the elongate body, the gear teeth substantially surrounding the passage; a pin movably disposed within the elongate body and engageable with the plurality of gear teeth, where the elongate body is operable to rotate the plurality of gear teeth when the pin engages the plurality of gear teeth. The wrench may include a spring coupled to the pin and the elongate body, and a compression of the spring may be selectively adjustable. The wrench may include a cap coupled to the elongate body and operable to selectively adjust the compression of the spring. The elongate body may include a handle.

A polyaxial tool is provided, including an elongate body defining a first end, a second and a longitudinal axis extending therebetween; the elongate body defining a cavity at the first end; a plurality of arcuate gear teeth circumferentially arranged in the cavity and movable with respect to the elongate body; a socket coupled to the housing and coaxial with the plurality of gear teeth; and a handle coupled to the second end, where an angular position of at least one of the elongate body and handle is adjustable with respect to the plurality of gear teeth. The elongate body may be releasably engageable with at least one of the plurality of gear teeth. The tool may include a pin movably coupled to the elongate body, where the pin releasably engages the elongate body to the at least one of plurality of gear teeth. The pin may engage the at least one of plurality of gear teeth until a maximum torque threshold is reached. The tool may include a spring coupled to the pin. The elongate body may be rotatable about the plurality of arcuate gear teeth along three different axes.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
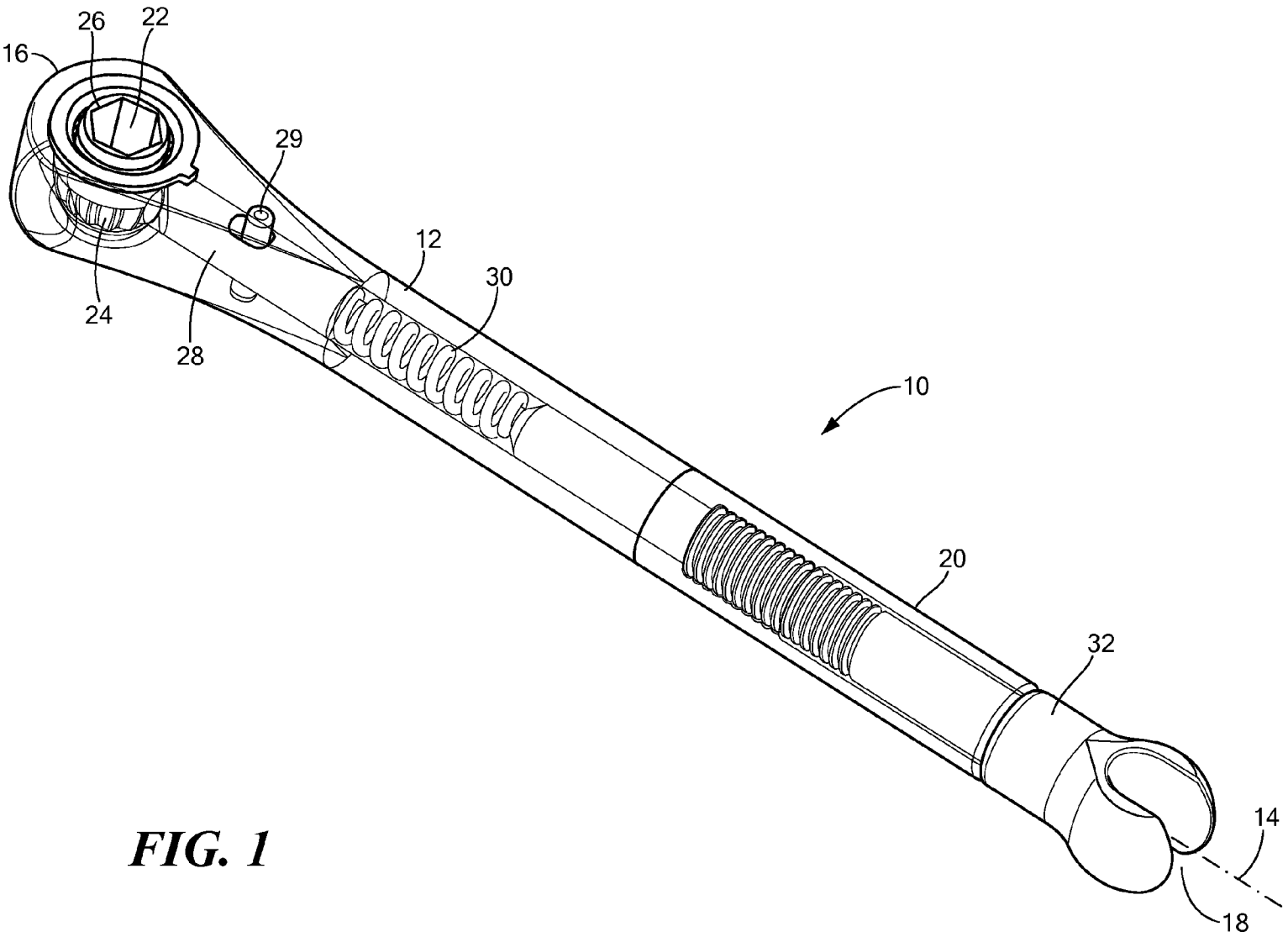
FIG. 1 is a perspective view of an example of a polyaxial tool constructed in accordance with the principles of the present disclosure.
Figure 2:
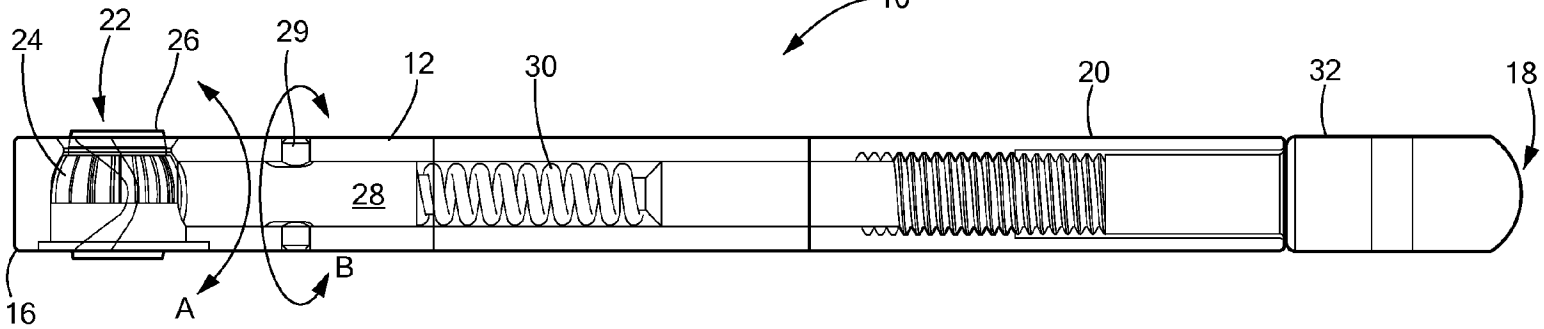
FIG. 2 is a side view of the polyaxial tool of FIG. 1.
Figure 3:
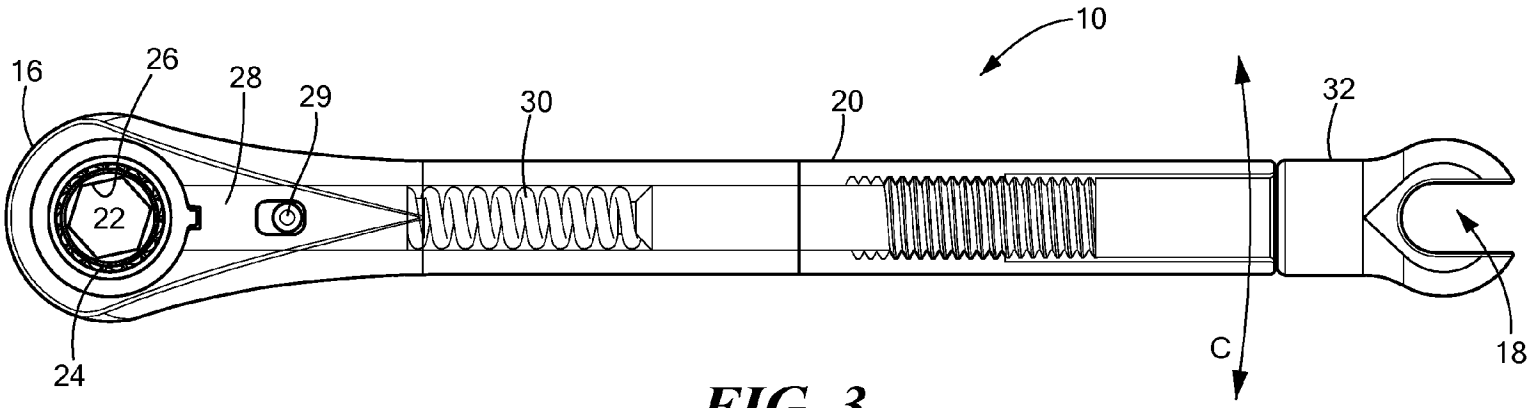
FIG. 3 is another side view of the polyaxial tool of FIG. 1.

The present invention advantageously provides tools and devices for a surgical or medical practitioner, the tools having a wide range of angular adjustability and compactness at a fastener or hardware engagement site that is readily usable in tortuous anatomical spaces and surgical sites. Now referring to the figures in which like reference designators refer to like elements, there is shown in FIGS. 1-3 an exemplary medical tool or device constructed in accordance with the principles of the present invention, designated generally as "10." The tool 10 may include a driver, wrench and/or ratchet tool 10 operable to turn a fastener or other hardware at a variety of different angles with a limited and/or selectable amount of applied torque.

The tool 10 generally includes an elongate driver body 12 or housing sized and dimensioned to couple to one or more fasteners or hardware. The body 12 may generally define a longitudinal axis 14 and include a first end 16 adapted to couple to a particular fastener or range of fasteners and a second end 18 graspable or operable by a user to impart torque and or rotation to an engaged fastener or hardware component. The body 12 may define or include a handle 20 in proximity to the second end 18. For example, the handle 20 may include an integral length or portion of the body 12 itself, or alternatively may include a construct that is removable or releasable from the driver body 12. The handle 20 may include one or more contoured surfaces easing manipulation of the tool 10 and may be constructed from one or materials that enhance grip.

The first end 16 of the body 12 of the tool 10 may define a passage 22 therethrough extending substantially transversely to the longitudinal axis facilitating engagement of the tool 10 body 12 to a fastener. The tool 10 may include a plurality of gears 24 movably coupled to the driver body 12 and substantially surrounding or circumscribing the passage 22. The gears 24 may each define an arcuate shape or curvature, and may be circumferentially spaced or arranged around the passage 22 such that the plurality of gears 24 presents a substantially spherical shape or configuration. For example, as shown in FIGS. 1-2, the gears 24 terminate in an upper edge or plane and a lower edge or plane to present a truncated spherical shape substantially coaxial with the passage 22 of the driver body 12. The driver body 12 may define a cavity or hollowed-out recess around the passage sized to movably accommodate the plurality of gears 24 therein. The plurality of gears 24 may form a ball-and-socket 26 joint with the handle 20 and/or driver body 12 to permit movement or manipulation with respect to one another about a plurality of axes. For example, the body 12 and/or handle 20 may be movably with respect to the gears 24 around three different axes, e.g., the handle 20 and/or body 12 may pivot "up" and "down" as shown by the arrow "A" in FIG. 2, may rotate about the longitudinal axis as shown by the arrow "B", and may turn or rotate around a diameter of the passage and/or plurality of gears 24, as shown by the arrow "C" in FIG. 3.

The tool 10 may include a socket 26 at the first end of the driver body 12 that is releasably engageable with a fastener. The socket 26 may be coaxially disposed with the passage 22 and/or the plurality of gears 24 such that rotation of the gears 24 results in rotation of the socket 26. The socket 26 may present a shape or dimensioned series of walls to abut varying sides of a fastener or piece of hardware. For example, as shown in FIG. 1, the socket 26 may define a hexagonal interface. The socket 26 may also include one or more adaptors or intermediary components (not shown) to facilitate engagement to a fastener.

The plurality of gears 24 may be selectively engageable with the driver body 12 to limit a torque or wrenching force transmitted from the driver body 12 and/or handle 20 to the socket 26, and thus an engaged fastener. For example, the tool 10 may include a pin 28 movably disposed within at least a portion of the driver body 12 and operable to releasably couple the driver body 12 and/or handle 20 to at least one of the plurality of gears 24. The pin 28 may be positioned within an interior cavity or hollowed portion of the driver body 12 and/or handle 20 such that a portion of the pin 28 is positionable between any two of the plurality of gears 24 at the first end. The tool 10 may include a biasing element 30, such as a spring or other resilient and/or resistive component that urges the pin 28 into contact and engagement with the gears 24. The tool 10 may also include a feature limiting the range of movement of the pin past a certain point towards or away from the gears 24. For example, the tool may include a rod 29 that passes through an oversized opening in the pin 28 to limit or define a movable range of motion of the pin 28.

When the pin 28 is engaged or positioned between two spaced gears 24, rotation of the driver and/or handle 20 imparts torque to the gears 24, and thus the socket 26, to rotate an engaged fastener. However, when a maximum torque threshold is reached or exceeded, the force causes the pin 28 to skip or step across the gears 24 without substantial movement of the gears 24, and thus the socket 26. The force required to cause a step or skip of the pin 28 with respect to the gears 24 may be selected or affected at least in part by a slope or angled interface between one or more of the gears 24 and a profile of the pin 28. The maximum torque threshold may further be manipulated by adjusting a compression or resistive state of the biasing element 30—for example, by tightening or loosening a compression of the spring. The tool 10 may include a cap or other actuator 32 coupled to the biasing element and the elongate body 12 and/or housing, and operable to adjust or select a pre-set compression or expansion of the spring, and thus the particular torque threshold transferable to the gears 24, the socket 26, and a connected fastener. The cap or actuator 32 may include indicia or indicators reflecting a particular selected torque based on a position of the actuator and/or the spring.

The tool 10 may also include a secondary engagement feature 34 at the second end 18 that can be used to rotate or drive a fastener or hardware without a torque limitation and/or to couple to an auxiliary bar or tool (not shown) to aid in rotating the body 12 and/or handle 20 of the tool 10. For example, the secondary engagement feature may define a cavity or second socket matable to a fastener and/or an auxiliary tool.

In an exemplary method of use, the tool 10 may be used to selectively rotate or tighten a fastener or hardware component to a pre-selected torque threshold. The cap or actuator 32 may be manipulated to establish a desired maximum torque threshold that the handle 20 and/or driver body 12 can impart to the gears 24, the socket 26, and thus an engaged fastener. This may include, for example, placing a predefined compression on the biasing element 30 known to result in a maximum torque threshold at which the pin 28 skips gears 24. Once selected, the socket 26 may be coupled to the fastener, where the coupling may be facilitated at least in part by manipulation of the driver body 12 and/or the handle 20 along any one or more of the available axes of motion. The maneuverability of the handle 20 and/or driver body 12 about the socket 26 itself provides added maneuverability in small or tortuous spaces. The handle 20 or driver body 12 may subsequently be used to turn the gears 24, the socket 26, and thus the fastener until the maximum torque threshold is reached, at which point the pin 28 becomes dislodged or disengaged from the gears 24. When a force on the pin 28 is reduced under the threshold, the pin 28 again re-engages the plurality of gears 24 automatically due to the urging of the biasing element. Should the direction of rotation of the fastener need to be reversed, the driver body 12 and socket 26 may simply be inverted, with the fastener entering the socket 26 and/or passage form the opposite side, with the same torque-limiting function availability.

It will be appreciated by persons skilled in the art that the present invention is not limited to what has been particularly shown and described herein above. In addition, unless mention was made above to the contrary, it should be noted that all of the accompanying drawings are not to scale. Of note, the system components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Moreover, while certain embodiments or figures described herein may illustrate features not expressly indicated on other figures or embodiments, it is understood that the features and components of the examples disclosed herein are not necessarily exclusive of each other and may be included in a variety of different combinations or configurations without departing from the scope and spirit of the invention. A variety of modifications and variations are possible in light of the above teachings without departing from the scope and spirit of the invention, which is limited only by the following claims.

What is claimed is:

1. A polyaxial driver, comprising:

a socket adapted to couple to a fastener;

a plurality of arcuate gear teeth circumscribing the socket;

a driver body having a longitudinal axis and being engageable with the gear teeth to rotate the socket until the maximum torque threshold is reached, wherein the driver body forms a ball-and-socket joint with the gear teeth and is rotatable about the plurality of arcuate gear teeth along three different axes;

a pin disposed within the driver body, the pin being coaxial with the longitudinal axis of the driver body and having an opening that extends substantially transversely to the longitudinal axis of the driver body, and when the maximum torque threshold is reached the pin disengages the gear teeth; and a rod disposed within the opening of the pin, configured to limit movement of the pin.

2. The polyaxial driver of claim 1, wherein the maximum torque threshold is adjustable.

3. The polyaxial driver of claim 1, wherein the socket includes a passage therethrough adapted to receive the fastener from either side of the passage.

4. The polyaxial driver of claim 1, further comprising a handle attached to the driver body.

5. A wrench, comprising:

an elongate body defining a passage through a first end thereof;

a plurality of gear teeth arranged in a substantially spherical configuration and movable with respect to the elongate body, the gear teeth substantially surrounding the passage;

a pin having a longitudinal axis and being movably disposed within the elongate body and engageable with the plurality of gear teeth, the pin including an opening that extends substantially transversely to the longitudinal axis of the pin, wherein the elongate body is operable to rotate the plurality of gear teeth when the pin engages the plurality of gear teeth, and when the maximum torque threshold is reached the pin disengages from the plurality of gear teeth;

a rod disposed within the opening of the pin, configured to limit movement of the pin; and a spring coupled to the pin and the elongate body, a compression of the spring is selectively adjustable.

6. The wrench of claim 5, further comprising a cap coupled to the elongate body and operable to selectively adjust the compression of the spring.

7. The wrench of claim 5, wherein the elongate body includes a handle.

8. A polyaxial tool, comprising:

an elongate body defining a first end, a second and a longitudinal axis extending therebetween; the elongate body defining a cavity at the first end;

a plurality of arcuate gear teeth circumferentially arranged in the cavity and movable with respect to the elongate body;

a socket coupled to the housing and coaxial with the plurality of gear teeth; and a handle coupled to the second end, wherein an angular position of at least one of the elongate body and handle is adjustable with respect to the plurality of gear teeth in at least three different axes;

the elongate body engaging the gear teeth to rotate the socket until a maximum torque threshold is reached, causing the elongate body to disengage the gear teeth;

a pin movably coupled to the elongate body and having an opening that extends substantially transversely to a longitudinal axis of the pin, wherein the pin releasably engages the elongate body to the at least one of plurality of gear teeth;

a rod disposed within the opening of the pin, configured to limit movement of the pin; and a spring coupled to the pin, a compression of the spring is selectively adjustable.

9. The polyaxial tool of claim 8, wherein the pin engages the at least one of plurality of gear teeth until the maximum torque threshold is reached.

* * * * *